US005231816A

United States Patent [19]

Lynch et al.

[11] Patent Number: 5,231,816

[45] Date of Patent: Aug. 3, 1993

[54] METHOD OF PACKAGING A BEVERAGE

[75] Inventors: Francis J. Lynch, Glenageary; Michael W. Coleman, Blackrock; Thomas P. Quinn, Swords, all of Ireland

[73] Assignee: Guinness Brewing Worldwide Limited, London, England

[21] Appl. No.: 900,008

[22] Filed: Jun. 17, 1992

[30] Foreign Application Priority Data

Jun. 25, 1991 [GB] United Kingdom ..... 9113650

[51] Int. Cl.[5] ..... B65B 31/00

[52] U.S. Cl. ..... 53/432; 53/79; 53/473; 220/906

[58] Field of Search ..... 53/473, 403, 432, 79, 53/84, 510; 426/115, 112; 220/906

[56] References Cited

U.S. PATENT DOCUMENTS 4,832,968 5/1989 Forage et al. ..... 53/79 X
4,995,218 2/1991 Byrne ..... 53/432 X
4,996,823 3/1991 Byrne ..... 53/432 X

*Primary Examiner*—James F. Coan

[57] ABSTRACT

A method of packaging a beverage having gas in solution has an open topped container 1 in which is located a hollow insert 5 having a restricted aperture 12. The container is charged with the beverage such as beer 15 so that the aperture 12 is submerged in the beverage and the container is sealed to form a headspace 19 which is pressurized, preferably by dosing with liquid nitrogen. Following sealing the container is rapidly inverted to locate the aperture 12 in the headspace 19 so that gas pressures in the insert chamber 10 and the headspace 19 come into equilibrium. With the fluid contents in equilibrium, or substantially so, the package is reinverted so that gas under pressure in the insert chamber 10 communicates directly by way of the aperture 12 with beer in the chamber 10. Upon opening of the headspace 19 to atmospheric pressure for dispensing the beer a pressure differential is developed by which gas from the insert chamber 10 is initially ejected through the aperture 12 into the beer 15 to effect in the development of a froth on the beer 15. Beer 30 which may flow into the insert chamber 10 prior to the aperture 12 moving to communication with the headspace 19 is accommodated within a well 13 of the insert chamber 10 remote from the aperture 12 to alleviate the ejection of such beer 30 into the beer 15.

9 Claims, 2 Drawing Sheets

METHOD OF PACKAGING A BEVERAGE

TECHNICAL FIELD & BACKGROUND ART

The present invention relates to a method of packaging a beverage. More particularly, the invention concerns the packaging of beverage having gas in solution in a sealed container of the kind which has a primary chamber containing the beverage and which forms a primary headspace comprising gas at a pressure greater than atmospheric; communicating with the primary chamber by way of a restricted orifice is a secondary chamber containing fluid at a pressure greater than atmospheric and which is arranged so that when the container is broached to dispense the beverage, the primary headspace is opened to atmospheric pressure and the pressure differential created by the decrease in pressure in the primary headspace causes fluid in the secondary chamber to be ejected by way of the restricted orifice into the beverage in the primary chamber and that ejection results in gas in solution in the beverage to be evolved and form, or assist in the formation of, a head of froth on the beverage.

An example of a beverage package of the kind discussed is disclosed in our European Patent 0 227 213 and following from that development, these packages have become very well known in the art and have met with considerable commercial success. Our aforementioned European Patent Specification is primarily concerned with the initial ejection of beverage from the secondary chamber, by way of the restricted orifice, into the primary chamber upon opening of the container by the pressure differential which is created between atmospheric pressure in the primary headspace and a secondary headspace which is at a pressure greater than atmospheric in the secondary chamber; the development of a desirable froth or head on the beverage is fully discussed in our European Specification and in the prior art to which it refers. Among that prior art is reference to our British Patent No. 1,266,351 which is directed to the initial ejection of gas from the secondary chamber by way of a restricted orifice into beverage in the primary chamber for the purpose of froth formation. Initial gas ejection from the secondary chamber to the primary chamber is considered, by some, to provide desirable characteristics of froth formation which are preferable to those achieved by initial beverage ejection. Furthermore tests have indicated that by use of intial gas ejection for froth development from the secondary chamber to the primary chamber, it is possible to reduce the pressure within the container when its sealed contents are in equilibrium as compared with such pressure as would be required for initial beverage ejection. The possibility of using relatively low pressure within the sealed container is undoubtedly desirable economically, environmentally and for safety reasons, particularly in a high speed filling line along which successive containers are charged with beverage and sealed to form the package.

Prior attempts to provide beverage packages of the kind discussed in which, upon opening, gas is initially ejected from the secondary chamber, through the restricted orifice and into the primary chamber for the purposes of head formation have met with little success commercially. Principally this was due to the difficulty and costs involved in achieving and maintaining the gas under pressure in the secondary chamber to ensure that such gas, and not beverage, was initially ejected through the restricted orifice and into the beverage in the primary chamber for froth development. As far as we are aware, attempts to achieve initial gas ejection have necessitated in the secondary chamber in the form of a hollow insert being charged and sealed with nitrogen gas under pressure remotely from the container and provided with a non-return valve associated with the restricted orifice. The sealed insert is placed in a container which is charged with beverage and itself sealed with the beverage under pressure. The beverage package is subsequently heated during pasteurisation causing the insert to deform so that the non-return valve becomes operative and responsive to the pressure differential previously mentioned whereby it permits the required initial gas ejection from the insert whilst preventing beverage from the primary chamber entering the secondary chamber of the insert. This remote nitrogen gas charging and sealing of the secondary chamber in the insert and the provision of a non-return valve in the structure of the insert require expensive manufacture and processing stages. In particular it is believed that the necessity for the insert to be subjected to heat deformation for its operational characteristics to become effective requires unreasonably expensive manufacturing costs for a reliable structure of the gas charged and sealed insert. Also the remote gas charging and sealing of the insert where the latter is of plastics can result in atmospheric oxygen migrating through the walls of the insert and into the secondary chamber to contaminate the nitrogen gas during the intervening period between the sealing of the insert and the sealing of the insert in the container. In the prior proposal of the gas filled and sealed insert, it has also been found necessary for the pressure in the primary chamber to exceed that in the secondary chamber to a considerable extent to ensure that the insert retains its foam initiation potential in the sealed container following the deformation of the insert by heating; further expense is therefore incurred in ensuring that adequate pressurisation is provided in the headspace of the sealed container. Even so it is also found that when the container is opened for consumption of the beverage and following gas ejection from the insert, a considerable charge of gas and residual pressure can be retained in the insert by the non-return valve—this may cause a relatively violent discharge if the insert is pierced or otherwise tampered with. It is an object of the present invention to provide a method of packaging a beverage to form a beverage package of the kind discussed in which upon opening of the package gas is initially ejected from the secondary chamber and by way of the restricted orifice into beverage in the primary chamber for the purposes of froth or head development and which method alleviates the disadvantages of the prior proposals.

STATEMENT OF INVENTION AND ADVANTAGES

According to the present invention there is provided a method of packaging a beverage having gas in solution therewith which comprises providing an upstanding container having a primary chamber with an open top and a secondary chamber which communicates with the primary chamber by way of a restricted orifice; charging the primary chamber with the beverage having gas in solution and so that the restricted orifice is submerged in the beverage in the primary chamber; sealing the container to form a sealed package with a primary headspace in the primary chamber containing gas at a pressure greater than atmospheric; rotating the package to locate the restricted orifice in the primary headspace and permitting the gas and liquid contents of the package, substantially, to come into equilibrium so that when the sealed package is further rotated to submerge the restricted orifice in the beverage in the primary chamber and the gas and beverage contents of the package are in equilibrium, gas at a pressure greater than atmospheric pressure in the secondary chamber communicates directly by way of the restricted orifice with the beverage in the primary chamber whereby, when the container is broached to open the primary headspace to atmospheric pressure, the pressure differential which results from the decrease in pressure at the primary headspace causes gas in the secondary chamber to be ejected initially into the beverage in the primary chamber by way of the restricted orifice and said ejection causes gas to be evolved from solution in the beverage to form, or assist in the formation of, a head of froth on the beverage.

Preferably the container is in the form of a metal can into which a hollow insert is fitted and secured to provide the secondary chamber in the manner generally discussed in EP 0 227 213 and for convenience the present invention will usually refer to such a structure; it is to be realised however that the present invention is not intended to be restricted in its use to beverage packages of the aforementioned structure. For example, the invention can be applied to beverage packages in which the secondary chamber is formed integral with the container and the latter can be of a material other than metal such as a plastics or glass bottle or a carton.

In high speed beverage packaging lines, such as for stout, ale, lager or other beer or even other alcoholic beverages or so-called soft drinks having gas in solution, open topped cans are moved in an upstanding condition successively along a filling line and each can receives through its open top and within its primary chamber a hollow insert, usually of plastics, which provides the secondary chamber and has in its wall an appropriately located restricted orifice. The insert is secured, usually on the bottom of the primary chamber and conveniently as an interference or friction fit, in the can. The container is now charged with its appropriate volume of beverage so that the restricted orifice in the insert (and usually the whole of the insert) is submerged in the beverage. The open top of the can is now sealed so that a primary headspace is formed by the beverage in the primary chamber with a gas in the headspace at a pressure greater than atmospheric. Such pressurisation of the primary headspace is conveniently achieved in known manner by depositing a dose of liquid nitrogen in the headspace of the can immediately prior to closing and sealing the open top. Following the sealing of the container, and in accordance with the method of the present invention, the sealed container is rotated to locate the restricted orifice of the secondary chamber in the primary headspace of the primary chamber thereby ensuring that the secondary chamber communicates directly, by way of the restricted orifice, with the gas under pressure in the primary headspace. This rotation of the sealed container should be as rapid as is conveniently possible following the sealing operation so that the secondary chamber is moved into communication through the restricted orifice with the gas in the primary headspace as, and long before, the gas and beverage contents of the sealed container come into equilibrium. Usually the rotation of the sealed container will be effected by inverting it on the filling line as it progresses away from the sealing station so that the package is rotated, top-to-bottom, through 180° and the hollow insert which was initially located at the bottom of the package is disposed at the top of the package on the line.

It is appreciated that when the container is initially charged with beverage a head of pressure will be applied in an attempt to cause beverage flow through the restricted orifice into the secondary chamber. Also the beverage pressure at the restricted orifice will increase following the sealing of the container and the initial pressurisation of the primary headspace during the relatively small time interval which preceeds the sealed package being rotated to locate the restricted orifice in the primary headspace. It is therefore possible that a relatively small amount of beverage will enter the secondary chamber from the primary chamber by way of the restricted orifice as the fluid contents of the sealed container approach their state of equilibrium and before the restricted orifice communicates with the primary headspace. However, the dimensions of the restricted orifice together with the rapidity with which the package is rotated to locate the restricted orifice in communication with the primary headspace can ensure that any beverage in the secondary chamber is relatively small and can be accommodated within the secondary chamber without significantly affecting the required gas ejection when the package is opened.

On this latter point, the secondary chamber, especially when in the form of a hollow insert, may be designed to include a well region within which any beverage that enters the secondary chamber is accommodated clear of the restricted orifice (when the package is in an upstanding condition to be opened) so that such beverage in the well region is below the level of the restricted orifice and will not be ejected into the beverage in the primary chamber to ensure that the ejection is wholly gas from a secondary headspace in the secondary chamber which is formed above any beverage which enters that chamber.

With the container inverted for the restricted orifice to communicate with the gas in the primary headspace, it is possible that the whole of the secondary chamber will be located in the primary headspace (but this is by no means necessary). The gas and beverage contents of the package will, substantially, come into equilibrium in a relatively short period following the can inversion. Eventually, possibly while still moving along the filling line, the package will be reinverted to its original upstanding condition so that the restricted orifice is submerged within the beverage. However, because the pressures within the primary and secondary chambers are substantially in equilibrium, the flow of beverage from the primary chamber into the secondary chamber by way of the restricted orifice is restrained and the gas at a pressure greater than atmospheric in the secondary chamber communicates directly with the beverage in the primary chamber by way of the restricted orifice. Consequently the required gas ejection is achieved for the development of froth on the beverage when the primary headspace is opened to communicate with atmospheric pressure, usually by opening the top of the can with a ring pull or other convenient means.

It is realised that it is well known in conventional lines for filling, sealing or otherwise handling of containers such as cans to invert the cans for various purposes as they progress along the line. For example it may be convenient to temporarily invert a can for the purpose of observing fluid leaks or to alleviate the possibility of water retention in an end seam of the can (usually when the sealed can is subjected to pasteurisation by jets of hot water) or merely for the convenience of packaging presentation. Consequently the techniques and facilities required to effect automatic and rapid can inversion, such as by use of robotic arms or by dropping the cans through a twist from a high level conveyor part to a low level conveyor part, are well known and need not be discussed herein. The fact that container inversion subsequent to sealing is well known will not detract from the merits of the present invention in so far as with the prior proposals the container inversion is effected a relatively long way down the line from the beverage filling and sealing stations. Therefore a considerable time would elapse between the sealing and inversion operations during which the contents of the sealed package would come into equilibrium causing the secondary chamber to partially fill with beverage derived from the primary chamber by way of the restricted orifice so that upon opening of the sealed package, beverage would initially be ejected from the secondary chamber through the restricted orifice into the beverage in the primary chamber for froth development in a similar manner to that discussed in the preferred embodiment of our European Patent 0 227 213.

In practical tests we have found that by using the packaging method of the present invention for a beer product in a container having substantially the same characteristics as those discussed in the preferred embodiment of our aforementioned European Patent, it is possible to provide the primary chamber with a primary headspace pressure, when in equilibrium, of approximately 32 p.s.i. (2.18 bar) when using the initial gas ejection as compared with a corresponding primary headspace pressure of 40 p.s.i. (2.80 bar) when using the initial liquid beverage ejection for the head formation. Consequently the present invention can provide considerable economies in achieving the required primary headspace pressurisation and a reduction in the hazards which are usually associated with the handling of pressurised gases and containers.

DRAWINGS

One embodiment of the present invention as applied to the packaging of a fermented beverage such as stout in a can will now be described, by way of example only, with reference to the accompanying illustrative drawings in which the FIGS. 1 to 4 diagrammatically illustrate the progressive stages in the formation of the beverage package in a canning line.

DETAILED DESCRIPTION OF DRAWINGS

Figure 1:
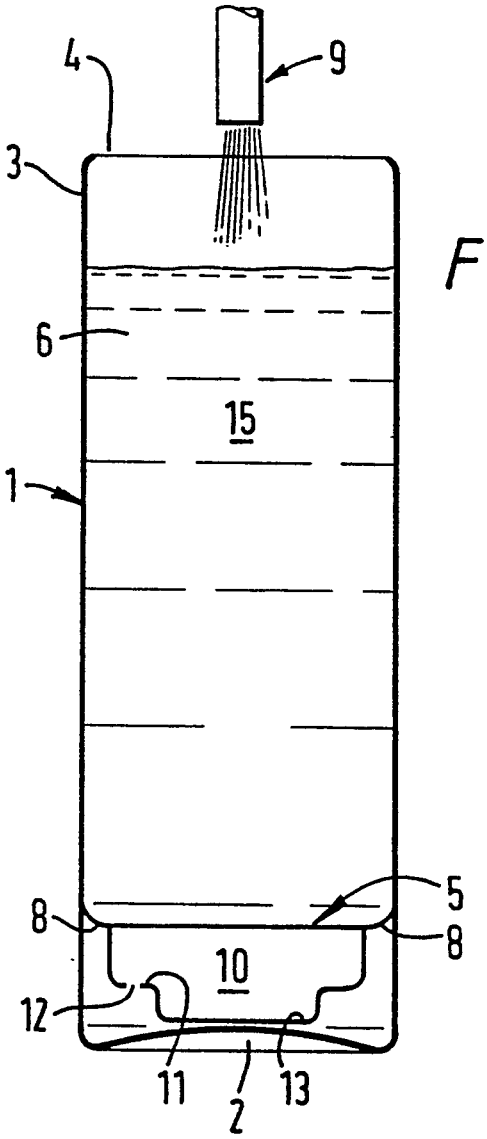

The present invention will be considered in relation to the preparation of a sealed container containing stout having in solution a mixture of nitrogen and carbon dioxide gases. The carbon dioxide gas content of the stout may be as discussed in the preferred embodiment of EP 0 227 213 while the nitrogen gas content of the stout may be reduced by approximately 1.5% from that discussed.

The stout is to be packaged in a conventional form of cylindrical can having a base 2 with an upwardly extending cylindrical side wall 3 forming an open top 4. The can 1 typically will have a capacity of 500 milliliters and is moved in its open topped upstanding condition along what may be regarded as a conventional beverage filling and sealing line.

As the can 1 progresses along the line a hollow plastics insert 5 is passed through the open top 4 of the can and into a primary chamber 6 within the can. The insert 5 will usually be seated on the can base 2 (which in conventional light alloy beer cans presents a convex domed profile within the primary chamber 6 as shown in the drawings). The insert is secured in position at or towards the bottom of the can 1, conveniently by frictional engagement of flanges 8 on the insert with the cylindrical wall 3 of the can (although it will be appreciated that other means can be provided for retaining the insert at its desired position in the can).

The insert 5 forms a secondary chamber 10 within the primary chamber and has, in a downwardly directed shoulder 11 of its wall, a restricted orifice 12 which provides permanent communication between the primary and secondary chambers 6 and 10. In the present example the secondary chamber 10 has a volume of approximately 16 milliliters and the restricted orifice 12 a diameter in the range of 0.002 to 0.040 inches (0.05 to 1.0 millimeters), preferably 0.010 to 0.020 inches (0.25 to 0.50 millimeters). The insert 5 is profiled so that when located in the bottom of the can 1 and with the latter in an upstanding condition, the secondary chamber 10 extends into a well 13 below the level of the restricted orifice 12. To alleviate contamination, particularly oxidation, of the stout which is to be packaged, it is preferred that the secondary chamber 10 is substantially purged of air, conveniently by nitrogen gas.

Following the fitting of the insert 5 the can progresses to a beer filling station 9 where it is charged, in the present example, with 440 milliliters of stout 15 (although in practice the volume of stout may be slightly in excess of that mentioned, say 442 to 444 milliliters, for reasons which will be explained hereinafter).

The can 1 passes from the filling station 9, through a pressurising station, to a seaming/sealing station (neither of which is shown as they may be regarded as conventional). At the pressurising station a dose of liquid nitrogen is applied into the headspace of the container 1 above the stout 15 so that the nitrogen gas which evolves from the liquid dose may purge the headspace 15 of air and will serve to pressurise the can when it is sealed. At the seaming station a closure disc 17 having a ring pull opener 18 (or other conventional form of can opener) is applied to close and seal the open top 4 by seaming to the cylindrical side wall 3. The sealed package thus formed has a headspace 19 over the beverage 15 within the primary chamber 6.

Figure 2:
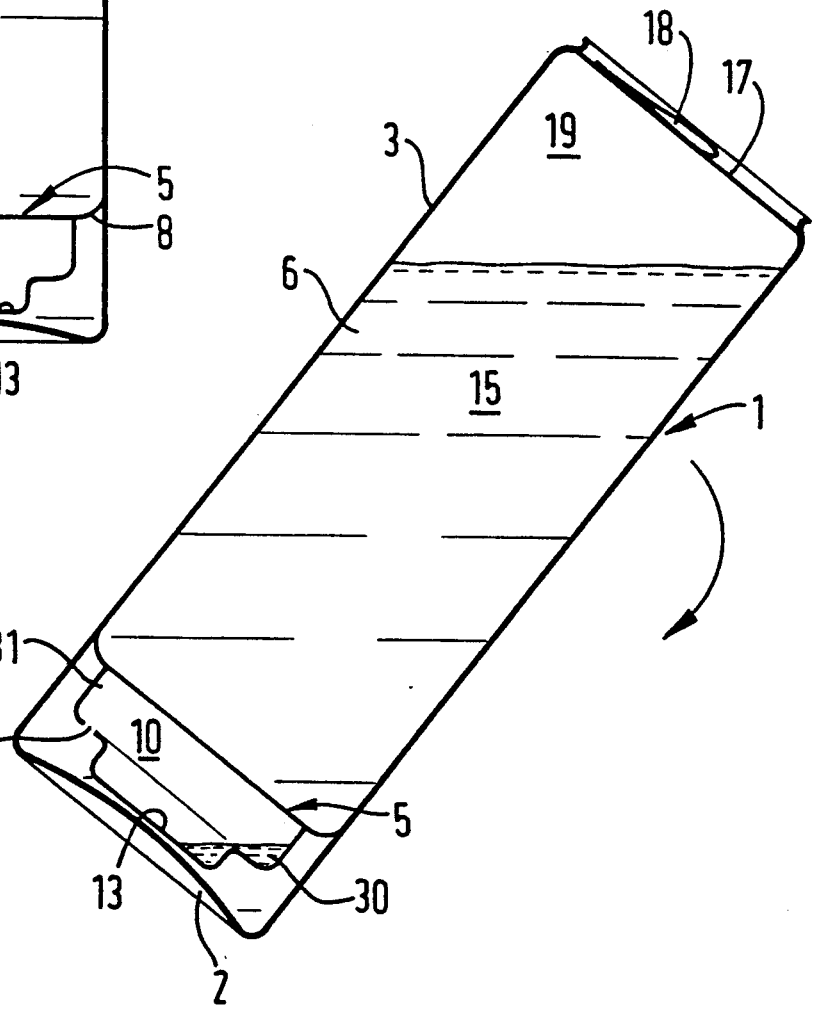

From FIGS. 1 and 2 it will be apparent that the restricted orifice 12, and indeed the whole of the insert 5, is submerged within the beverage 15. Immediately following the sealing of the container 1, or as rapidly as is convenient and practical thereafter, the sealed package is rotated, top-to-bottom, through 180° as shown in the progression from FIG. 2 to FIG. 3 to stand relatively inverted on the filling line. The inversion of the sealed container can be effected by conventional means, for example during movement of the can 1 along the line it may pass between retaining guide rails through which the can 1 effectively drops and twists over a relatively short length of the line to be re-orientated in its relatively inverted upstanding position.

Figure 3:
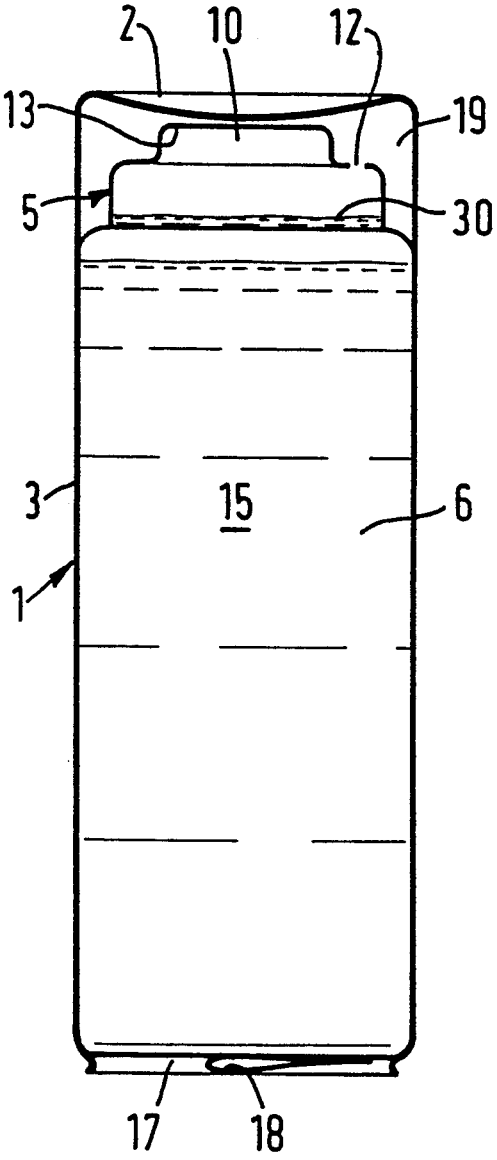

With the sealed container in its "inverted" position as shown in FIG. 3, the restricted orifice 12 of the insert 5 communicates directly with the headspace 19 in the primary chamber 6 and consequently the gas pressure within the secondary chamber 10 will come into equilibrium with the gas pressure in the primary headspace 19. Following the liquid nitrogen dosing and sealing stations the pressure of gas in the primary headspace 19 will increase progressively as the liquid nitrogen evaporates and when the gas and beverage contents of the sealed container are in equilibrium, the liquid nitrogen dose that is applied together with the other characteristics of the container are arranged so that the pressure within the primary headspace 19 is approximately 32 p.s.i. (2.18 bar).

Figure 4:
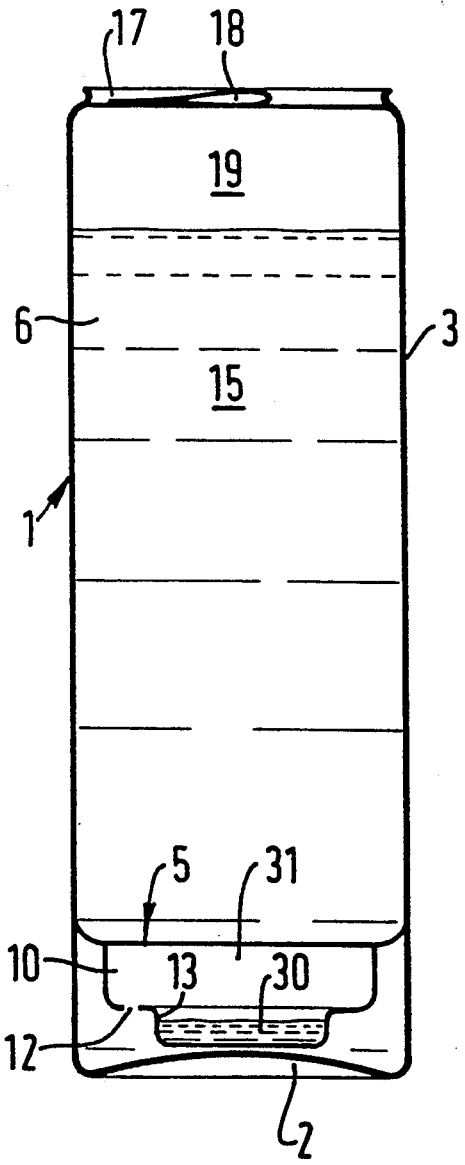

After a predetermined period following the aforementioned inversion of the sealed container 1 and when the contents thereof are in equilibrium or substantially so, the sealed container may be re-inverted in its movement along the line to adopt its original upstanding condition as shown in FIG. 4. In FIG. 4 the pressures within the primary headspace 19 and the secondary chamber 10 are in equilibrium so that gas in the secondary chamber 10 communicates by way of the restricted orifice 12 directly with beverage 15 in the primary chamber 6 while the fluid pressure balance and restricted nature of the orifice 12 restrains flow of beverage from the primary chamber into the secondary chamber.

Upon opening of the sealed package by the ring pull 18 to dispense the beverage 15, the pressurised headspace 19 rapidly de-pressurises to atmospheric pressure. As a consequence the gas pressure within the secondary chamber 10 exceeds that in the headspace 19 and causes gas in the secondary chamber to be ejected by way of the aperture 12 into the stout 15 in the primary chamber of the can. The effect of the gas ejection and its high speed entry into the stout 15 causes gas in solution in the stout to be liberated and form, or assist in the formation of, the desired head of froth on the beverage 15.

It has previously been mentioned that the inversion of the sealed package to the condition shown in FIG. 3 should be effected as rapidly as possible following the charging of the open top container 1 with the stout as shown in FIG. 1. Tests have indicated that in a beer canning line running at, for example, 400 to 500 cans per minute it is possible for a sealed container to attain its inverted position of FIG. 3 approximately 1 to 8 seconds after leaving the sealing station with the can commencing its inversion approximately 0.1 to 2 meters along the line from the sealing station and being inverted over a drop-twist length of approximately 1 meter.

The insert 5 will usually be deposited in the open topped container 1 with its secondary chamber 10 substantially at atmospheric pressure and purged of air by nitrogen gas. Consequently a head of pressure will be provided by the stout with which the container is charged to create a small pressure differential between the stout and the pressure in the secondary chamber 10. Furthermore, this latter pressure differential will be increased by the sealing and pressurisation of the headspace 19. The restricted size of the orifice 12 will tend to restrain entry of stout from the primary chamber through that orifice and into the secondary chamber 10. Nevertheless it is possible that a small amount of stout 30 will enter the secondary chamber 10 through the aperture 12 to form a secondary headspace 31 in the secondary chamber even during the relatively short period prior to the aperture 12 moving into communication with the primary headspace 19. It is therefore important to ensure that the inversion of the sealed container is effected as rapidly as possible to minimise the volume of stout 30 which enters the secondary chamber and to ensure that the volume of stout 30 is not sufficient to cover the aperture 12 when the sealed package is in its upstanding condition to be opened for dispensing the beverage 15. If in this latter condition the stout 30 covers the aperture 12, the secondary headspace 31 will contain gas under pressure greater than atmospheric pressure so that when the sealed package is opened for dispensing the stout, the pressure differential which develops between the secondary headspace 31 and primary chamber 19 will cause stout 30 and not gas, to be ejected into the beverage 15 in the primary chamber in the manner of the teaching in our European Patent 0 227 213 (however, such ejection of the stout 30 may provide inferior characteristics for head formation as compared with the ejection of stout as discussed in our aforementioned European Patent as the desirable pressure within the headspace 31 for stout ejection should be greater than that required for gas ejection, say 40 p.s.i.. as compared with 32 p.s.i.).

Such stout 30 as flows into the secondary chamber 10 is accommodated in the well 13 of that chamber and this well is appropriately shaped and sized to maintain the stout 30 remote from the orifice 12 when the container is in its conventional upright condition to be opened to ensure that the desired gas ejection is achieved upon opening of the sealed package. The stout 30 will be retained within the hollow insert 5 and eventually discarded so that it will be lost to the consumer. In practice and to compensate for this loss, the container will be charged at the filling station with a volume amounting to that which is stated to be dispensed to the consumer plus that which would be retained in the insert. In the present example, the stout 30 which will be retained in the insert may be in the order of 2 to 4 milliliters and this of course may also be considered a loss to the manufacturer—again emphasising the desirability of rapidly inverting the sealed package so that the pressures of its fluid contents can come into equilibrium substantially while the restricted orifice 12 is in communication with the primary headspace 19 and the volume of stout 30 in the secondary chamber 10 is minimised.

In the above described embodiment the restricted orifice 12 is shown, with the filled container in an upstanding condition in which it will usually be placed for opening the package, arranged so that the gas to be ejected from the secondary chamber 10 or secondary headspace 31 downwardly into the beverage in the primary container—it is to be realised however that the restricted orifice 12 can be located on the insert in other positions either to direct the gas ejection relatively upwardly or sideways into the beverage in the primary chamber. Furthermore, although a single restricted orifice 12 has been shown it will be appreciated that two or more restricted apertures can be provided through which gas ejection is effected. If the restricted orifice or orifices are directed upwardly into the beverage and these provide direct communication between the primary and secondary chambers, the orifice diameter will be selected to alleviate the likelihood of beverage flow into the secondary chamber caused by vibration of the sealed package during transport. If required the open-topped container can be charged with beverage prior to the insert being located within the container and submerged in the beverage.

We claim:

1. A method of packaging a beverage having gas in solution therewith which comprises providing an upstanding container having a primary chamber with an open top and a secondary chamber which communicates with the primary chamber by way of a restricted orifice; charging the primary chamber with the beverage having gas in solution and so that the restricted orifice is submerge in the beverage in the primary chamber; sealing the open top of the container with an openable top to form a sealed package with a primary headspace in the primary chamber containing gas at a pressure greater than atmospheric; rotating the package to locate the restricted orifice in the headspace of the primary chamber and permitting the gas and liquid contents of the package, substantially, to come into equilibrium so that when the sealed package is further rotated to submerge the restricted orifice in the beverage in the primary chamber and the gas and beverage contents of the package are in equilibrium, gas at a pressure greater than atmospheric pressure in the secondary chamber communicates directly by way of the restricted orifice with the beverage in the primary chamber whereby when the sealed package is further rotated to an upstanding condition with is openable top uppermost and the container is broached by opening said openable top to open the headspace to atmospheric pressure, the pressure differential which results from the decrease in pressure at the primary headspace causes gas in the secondary chamber to be ejected initially into the beverage in the primary chamber by way of the restricted orifice and said ejection causes gas to be evolved from solution in the beverage to form, or assist in the formation of, a head of froth on the beverage.

2. A method as claimed in claim 1 in which during the period following the charging of the primary chamber with beverage and the location of the restricted orifice to communicate with gas pressure in the primary headspace, beverage from the primary chamber flows by way of the restricted orifice into the secondary chamber to form a secondary headspace therein, said secondary headspace maintains direct communication by way of the restricted orifice with the beverage in the primary chamber when the gas and liquid contents of the package are in equilibrium and the sealed package is in an upstanding condition to be opened, whereby when the container is broached to open the primary headspace to atmospheric pressure, the pressure differential which is developed causes gas from the secondary headspace in the secondary chamber to be ejected initially into the beverage in the primary chamber by way of the restricted orifice.

3. A method as claimed in claim 2 in which beverage in the secondary chamber is accommodated in a well of that chamber and, when the sealed package is in an upstanding condition to be opened, said beverage in the well is remote from the restricted orifice.

4. A method as claimed in claim 1 which comprises locating and securing the primary chamber a hollow insert having said secondary chamber and the said restricted orifice.

5. A method as claimed in claim 4 which comprises locating the hollow insert in the primary chamber prior to charging the primary chamber with the beverage.

6. A method as claimed in claim 1 which comprises pressurising the primary headspace by the application of a liquid nitrogen dose to the primary chamber prior to sealing the container.

7. A method as claimed in claim 1 which comprises rotating the sealed container by inverting it, top-to-bottom, through 180°.

8. A method as claimed in claim 1 in which the sealed package is rotated for the restricted orifice to communicate with the primary headspace within a period of substantially eight seconds from the container being charged with the beverage.

9. A beverage package when formed by the method as claimed in claim 1.

* * * * *

UNITED STATES PATENT AND TRADEMARK OFFICE

CERTIFICATE OF CORRECTION

PATENT NO. : 5,231,816

DATED : 08/03/93

INVENTOR(S) : Francis Lynch, Michael Coleman, Thomas Quinn

It is certified that error appears in the above-identified patent and that said Letters Patent is hereby corrected as shown below:

Title page, item [30],
Foreign Application Priority Data:

Please delete "9113650" and substitute--9113650.7--.

Signed and Sealed this

Twenty-sixth Day of April, 1994

*Attest:*

BRUCE LEHMAN

*Attesting Officer*

*Commissioner of Patents and Trademarks*